United States Patent [19]

Lotto

[11] Patent Number: 5,022,298

[45] Date of Patent: Jun. 11, 1991

[54] ROTARY HANDLE CUTOUT WITH HEATED KNIFE

[75] Inventor: Ronald L. Lotto, Bonduel, Wis.

[73] Assignee: FMC Corporation, Chicago, Ill.

[21] Appl. No.: 250,017

[22] Filed: Sep. 27, 1988

[51] Int. Cl.[5] ..... B26D 7/02

[52] U.S. Cl. ..... 83/509; 83/465; 83/566; 83/568; 83/659; 83/171

[58] Field of Search ..... 83/50, 509, 510, 511, 83/566, 565, 659, 512, 568, 465, 171; 30/360, 361

[56] References Cited

U.S. PATENT DOCUMENTS

| | | | |
|---|---|---|---|
| 2,066,381 | 1/1937 | Albertson | 83/465 |
| 2,782,855 | 2/1957 | Marcoux | 30/360 |
| 4,607,556 | 8/1986 | Piggot | 83/511 |
| 4,638,702 | 1/1987 | Debin et al. | 83/509 |
| 4,823,660 | 4/1989 | Forthmann | 83/123 |
| 4,825,739 | 5/1989 | Pfaff | 83/139 |
| 4,856,393 | 8/1989 | Braddon | 83/50 |

FOREIGN PATENT DOCUMENTS

| | | | |
|---|---|---|---|
| 1478845 | 4/1967 | France | 83/465 |

*Primary Examiner*—Frank T. Yost
*Assistant Examiner*—John M. Husar
*Attorney, Agent, or Firm*—Douglas W. Rudy; Richard B. Megley

[57] ABSTRACT

Continuously produced plastic bags are made with cutouts in the bags to serve as handles for the bags. A rotary wheel set is used to interface with a circumferential knife blade to cut the holes in the bags. An improved bag tensioning platen and holding apparatus is provided to improve the uniformity of holes being cut in the bags.

6 Claims, 3 Drawing Sheets

FIG_1
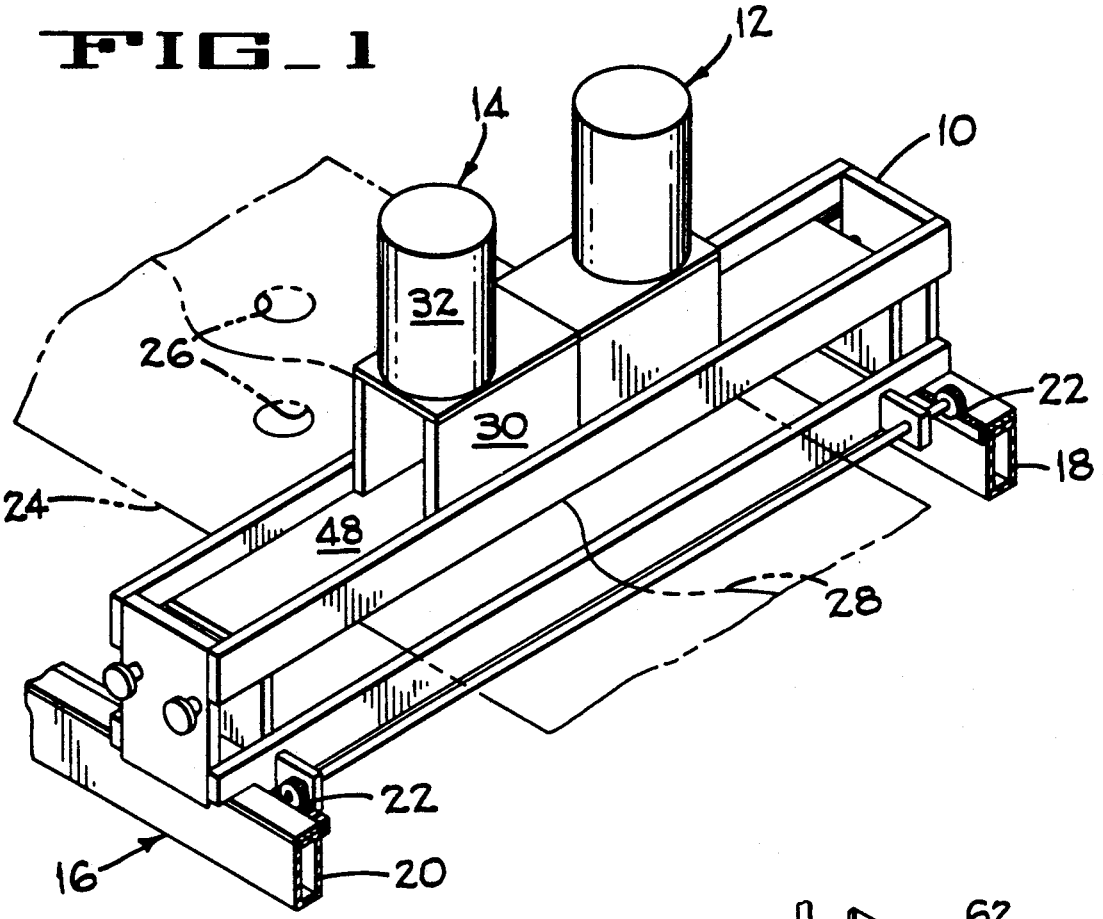
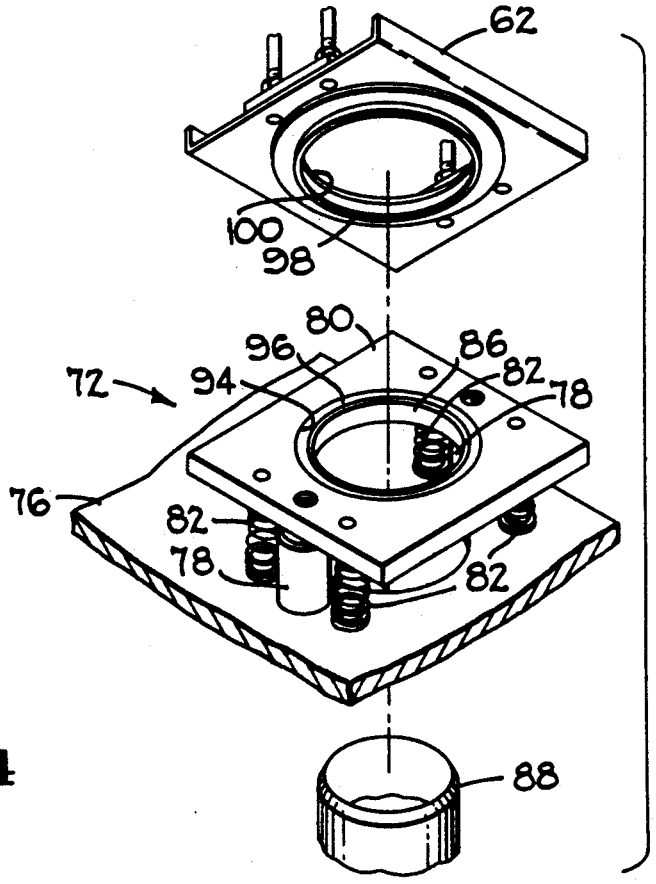
FIG_4

ROTARY HANDLE CUTOUT WITH HEATED KNIFE

BACKGROUND OF THE INVENTION

1. Field of the invention

This invention has to do with continuous production bag making machines that produce plastic bags from sheet or tube feed stock. The invention is an improvement to rotary hole cutters used in such bag making machines.

2. Description of Related Art

Rotary hole cutters having a configuration similar to that shown in the general drawing figures are known. Circular cutouts have previously been made in stock using roller wheels pressing the stock against a knife edge. When this technology is used in cutting holes in plastic bag material, however, where two layers of material need be cut at once, it has been found that the film retention means in the area confined to the hole to be cut were inadequate to hold the film. With the film insecurely held, there were often instances of erratic hole shapes, cut wrinkles, uncut sections of film where, for instance, the film was doubled over or the "wave" propagated by the wheels doubled over or the "wave" propagated by the wheels doubled over the film. Applicant has solved the problem of erratic cuts by improved methods and apparatus for holding the film to be cut in place more securely once the cutting cycle has begun.

BRIEF SUMMARY OF THE INVENTION

The invention provides a rotary hole cutter for cutting handle type holes in "sine-wave" cut plastic bags. The holes define a handle for the bag. The plastic bags comprise two thicknesses of plastic film or sheet wherein holes are cut simultaneously through both thicknesses of the plastic film making up the bag. A film clamp comprising an upper and a lower film clamp apparatus is uniquely configured to clamp two plies of film while the hole cutter rollers and knife blade cut the hole in the bag through the rotation of the cutter wheels on the circumferential knife blade.

BRIEF DESCRIPTION OF THE DRAWINGS

In the drawing figures:

FIG. 1 is a simplified pictorial drawing of the general environment of the invention.

FIG. 4 is an expanded view of the film clamp elements of the invention.

DETAILED DESCRIPTION OF THE INVENTION

Figure 2:
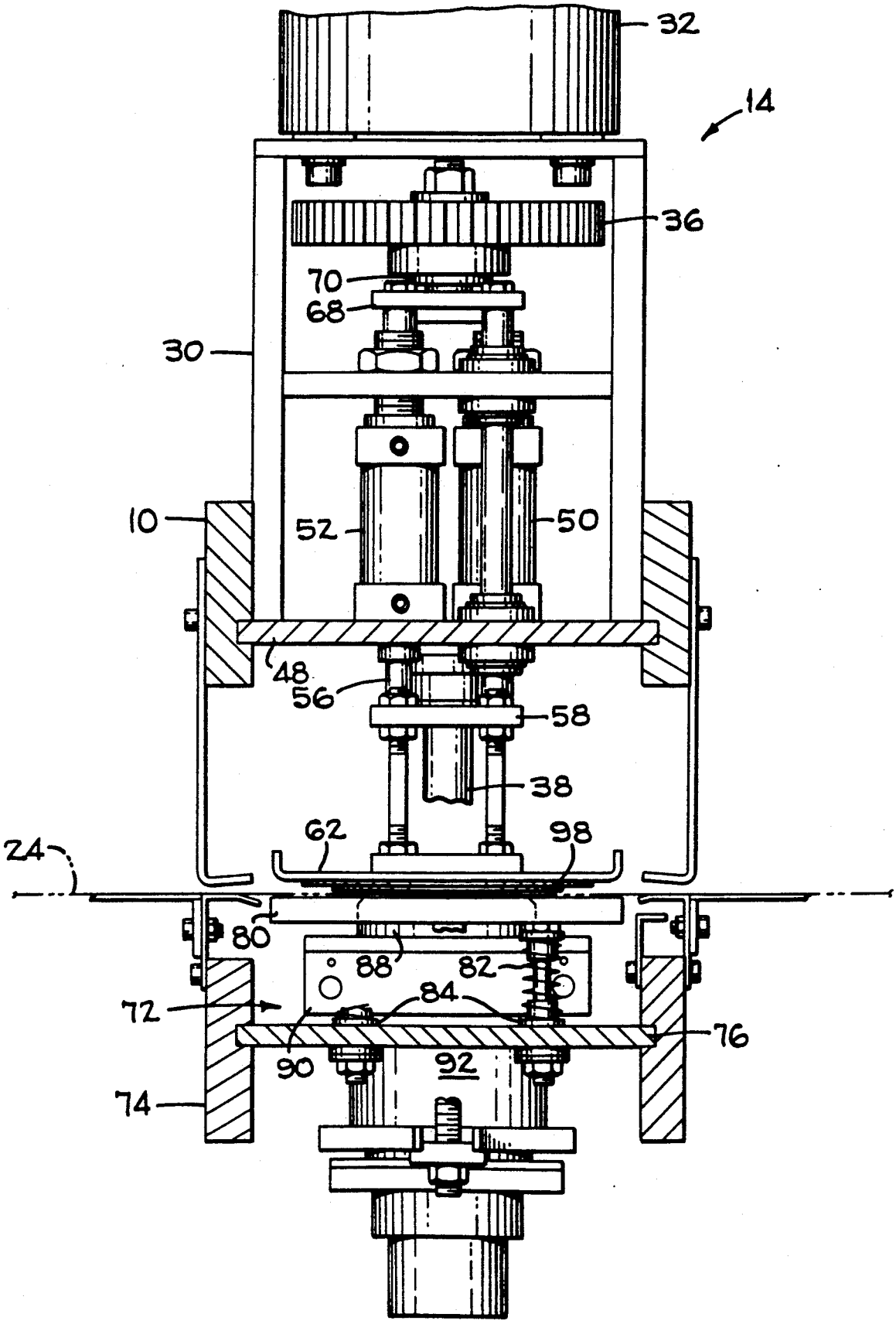
FIG. 2 is a partially sectional side elevation view of a rotary hole cutter incorporating the invention.

The invention herein will be readily understood from an examination of the drawing figures when read in conjunction with the following description of the drawings figures.

FIG. 1 presents a simplified pictorial presentation of the environment of the invention. What is shown is a bridge structure 10 that is the support for a pair of rotary hole cutters generally 12 and 14. The bridge structure 10 is supported on a bag making machine frame generally 16 which includes frame elements 18 and 20.

The bridge structure 10 can be moved along the frame elements 18 and 20 by use of a rack and pinion gear set generally 22 which can be operated in conventional means such as being power driven or manually driven. Typically the bridge structure will be indexed to move with the plastic bag web as the web is developed and the holes cut simultaneously therein. The bridge structure 10 will be moved laterally along the bag making machine frame 16 in order to properly locate the holes 26 in the plastic web 24. The terms "web", "film", "film web" and "sheet" are used interchangeably in this specification to refer to the material from which the bags are made.

The plastic web has been cut into two halves by a "sine wave cutter" that provides the "sine" cut such as 28. The holes, such as 26 are staggered left and right to correspond with the tallest section of the sine cut, that is the right side rotary hole cutter generally 12 cuts the holes in the plastic film on the right side of the sine cut and the left side rotary hole cutter, generally 14, cuts the holes in the plastic film on the left side of the sine cut. (The term "plastic" is used generally herein.)

FIG. 1 is a simplified general arrangement and is not presented as a limiting structure, for instance, the rotary hole cutters, 12 and 14, could be adjustably mounted on the bridge structure to move inboard or outboard.

Figure 3:
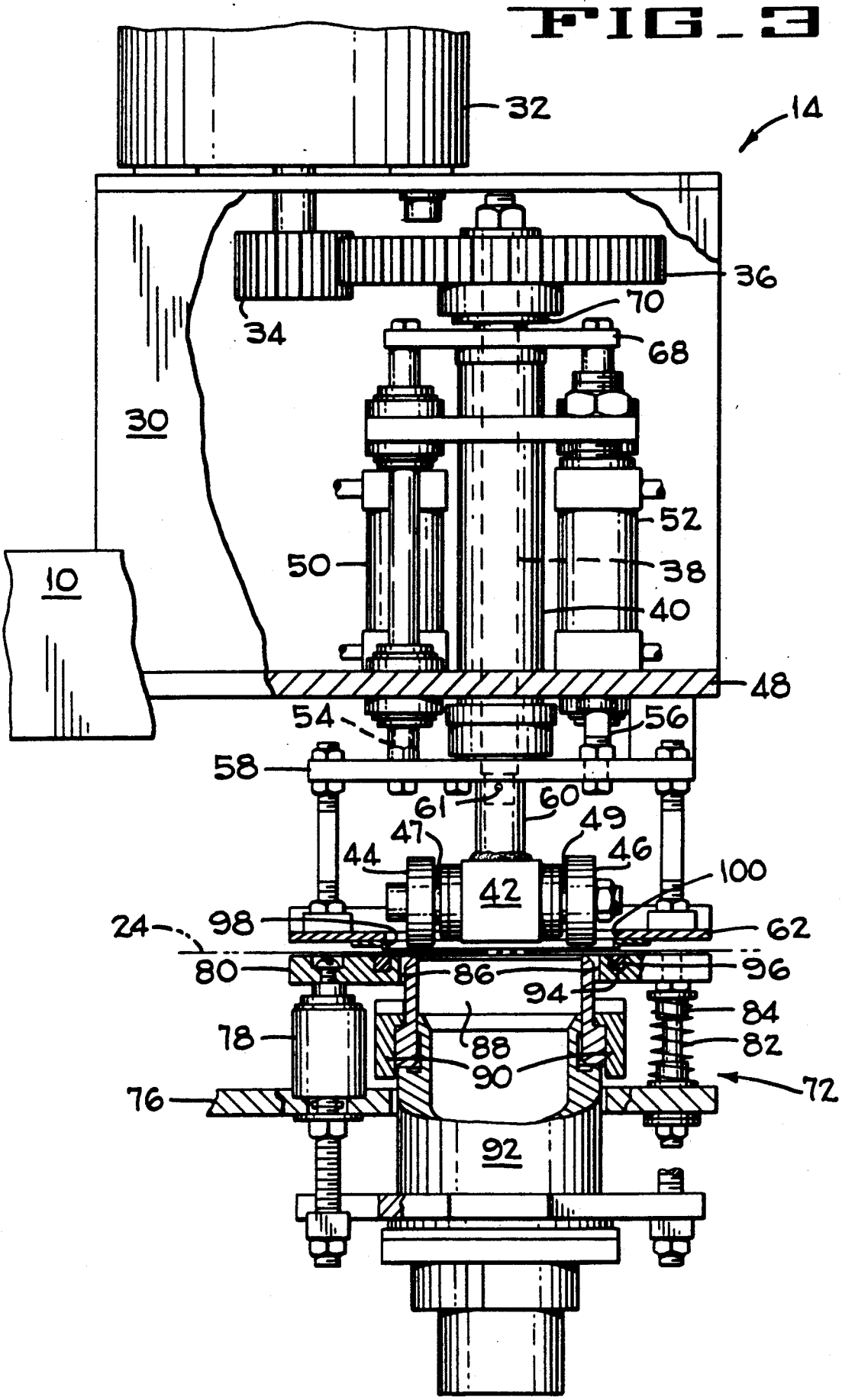
FIG. 3 is a partially sectional front elevation view of a rotary hole cutter incorporating the invention.

FIGS. 2 and 3 should be considered together as they are relatively detailed views of one of the hole cutters and like elements in each Figure, as well as those of the other two figures are represented by like reference characters. The actual pressure rollers are left out of FIG. 2 for simplicity.

In these Figures the bridge structure 10 is shown supporting one of the rotary hole cutters generally 14. The rotary hole cutter generally 14 includes a housing 30 which acts as the support structure for the rotary hole cutter machine elements. Supported on this housing 30 is a drive means 32, typically an electric or pneumatic motor, housing an output shaft supporting a drive gear 34 which in turn drives the driven gear 36 which is fixedly attached to a shaft 38 which is mounted in a shaft housing 40 for rotation and vertical displacement.

The lower end of the shaft 38 is fixedly mounted to a roller support axle 42 (in FIG. 3, removed for clarity from FIG. 2) which supports first and second pressure rollers 44 and 46. A pair of bushings, 47 and 49, provide shock mounting for the pressure rollers.

Attached to the stationary base frame member 48 are a pair of double acting air cylinders 50 and 52 that will cause the shaft 38 to move vertically downward from a position of repose. Alternative elements such as hydraulic cylinder or servo motors for instance are contemplated as alternatives.

In the embodiment shown (FIG. 3). when the double acting cylinders 50 and 52 are actuated, the rod extensions 54 and 56 will urge the plate 58, to which they are fixedly attached, downwardly. As the plate 58 progresses downwardly, it will contact a wider portion 60 (which in the embodiment shown is pinned to the shaft 38 by pin 62) of the shaft 38 causing the shaft 38 and its attached roller support axle 42 and the rollers 44 and 46 downward.

While the cylinders 50 and 52 urge the plate 58 downward they also push the pusher plate 62 downward as it is attached by means of adjustable supports.

Upon relative retraction of the double acting cylinders 50 and 52 the pressure rollers 44 and 46 and the pusher plate 62 will be raised upward and taken out of contact with the web of plastic film 24. The cylinders 50 and 52 will urge the upper plate 68 against element 70 which will lift the shaft 38 and the driven gear 36.

Below the plastic film web 24 the hole cutting head or anvil, generally 72, is positioned on a lower bridge structure 74 which rigidly supports a base 76. The base 76 supports an adjustment device, for instance a gear motor generally 78 that is used to adjust the distance between the base 76 and a stripper plate 80. Springs, such as 82 are journaled on spring supports 84 carried between the base 76 and the stripper plate 80 and will tend to urge these two components apart.

The stripper plate is provided with a large aperture 86 which is large enough to accommodate a circumferential, either circular or elliptical, cutting knife 88 having a knife edge at its upper proximate end.

The cutting knife 88 may be heated by means of heating blocks such as 90 proximate to the cutting knife itself. The cutting knife is tubular and is provided with a source of vacuum through a vacuum chamber 92. The vacuum apparatus is used to transport slugs of plastic web material that has been cut out of the plastic web 24 to a refuse storage location.

FIG. 4 provides a detailed view of the pusher plate 62 and the stripper plate 80. The cutting knife 88 is also shown. In this view it can be seen that there are two adjustment devices 78 and four spring assemblies 82 for each cutter assembly. Also it can be seen that the stripper plate 80 is further equipped with a circumferential groove 94 into which a rubber ring 96 has been placed.

As can best be seen in FIG. 3, the rubber ring 96 is positioned below, that is on the obverse side of the web path. A projecting lip 98 surrounds a large aperture 100 in the pusher plate 62. Immediately before cutting the plastic web the projecting lip 98 will trap the plastic web against the rubber ring 96 to provide secure gripping of the plastic film web as the hole is being cut.

The operation of the hole cutter is simple and can easily be envisioned by looking at FIG. 3. In this figure, as well as the other figures, the bite is open and will let the plastic film web pass unobstructed. Based on the timing of the hole cutter it will cycle a significant number of times per minute, on the order of 125 cycles per minute per cutting head, which is sufficient to produce a good production quantity of bags.

When the timer, not shown but conventionally known, signals the hole cutter to cut a hole, the air cylinders 50 and 52 will be actuated to lower the pressure rollers 42 and 44 down into contact with the plastic film web. The plastic film web has been "clamped" between the projecting lip 98 and the rubber ring 96 of the stripper plate 80.

It should be remembered that the pressure rollers 44 and 46 can be mounted flexibly through the use of bushings 47 and 49 such that when the pressure rolls are brought into contact with the cutting knife 88 a relatively controlled nonviolent engagement (separated by the plastic web) will take place.

Once proximate to, or in a preferred embodiment in relative contact with, the cutting knife 88 the pressure rollers 44 and 46 are rotated through a path of at least 180° by the rotation of the shaft 38.

An alternative embodiment would have the shaft rotating while it is being lowered into relative contact with the cutting knife 88.

Once the hole has been cut in the plastic web, usually a two thickness plastic bag, the pressure rollers are raised by the air cylinders 50 and 52 and the pusher plate is raised at the same time. The stripper plate 80 is spring loaded by means of the four springs such as 82 to push the plastic web out of contact with the cutting edge, which is heated in a preferred embodiment. Spring loading of the stripper plate 80 also assists in maintaining a tight seal to trap the plastic web between the projecting lip 98 of the pusher plate 62 and the stripper plate 80.

Timing of the engagement of the projecting lip 98 with the plastic web 24 and the stripper plate 80 is adjustable to ensure that the plastic web is secured before the pressure rollers 42 and 44 crush the plastic web and the cutting knife 88. Adjustment is made through adjusting the length of the adjustable supports 64 and 66. Also the adjustment devices such as 78 can be adjusted to raise or lower the stripper plate 80 relative to the base 76 to allow the clearance between the plastic web and the cutting knife 88 edge to be increased or decreased.

As stated above, it is contemplated that the bridge structure 10 and lower bridge structure 74 will be mounted on the machine rails to move in synchronism or registered movement with the plastic web being processed through the bag making machine. This method is preferred in that the lack of relative motion between the plastic web and the hole cutter makes good quality holes without the functional stress of relative acceleration and deceleration.

It is believed that the foregoing description of the invention clearly explains the nuances of its operation. It is apparent that persons of skill in the art will, however, conjure up alternative designs that don't depart from the spirit of the invention and such embodiments are intended to be fairly covered by the following claims.

What is claimed is:

1. In a bag making machine for manufacturing plastic bags with holes provided therein from a web of plastic material, said bag making machine having a rotary hole cutting apparatus, including a pair of pressure rollers mounted on a shaft perpendicular to a vertically disposed rotatable shaft and a cutting knife which will contact the bottom of said web of plastic material when said rollers contact the top of said web of plastic material, the improvement comprising:

a pusher plate, mounted for reciprocal motion above said web of plastic material movable to a position in contact with said web whereby said web may be deflected downwardly from the normal plane of web repose, said pusher plate having a projecting lip directed for engagement with said web;

a stripper plate, urged to a position of repose by spring means below said web, said stripper plate including a circumferential groove surrounding a large aperture in said stripper plate, said circumferential groove retaining a rubber ring means in registration with said projecting lip of said pusher plate.

2. The invention in accordance with claim 1 wherein said pusher plate is capable of urging said stripper plate from its position of repose to a position slightly below the position of said cutting knife.

3. The invention in accordance with claim 2 wherein said pusher plate is urged into indirect contact with said stripper plate by a cylinder fixedly mounted to said bag making machine.

4. In a bag making machine for manufacturing plastic bags from a web of plastic material, said bags having holes provided in said bags through the use of a rotary hole cutter, the improvement comprising:

a pusher plate mounted for reciprocal movement above said web of plastic material, said pusher plate having a large aperture and a lip circumferentially disposed around said large aperture;

a stripper plate having a large aperture mounted below said web of plastic material in alignment with said large aperture of said pusher plate, said stripper plate further having a rubber ring circumferentially disposed around said large aperture of said stripper plate.

5. The invention in accordance with claim 4 wherein said rotary hole cutter includes a cutting knife having a cutting edge mounted below said web of plastic material and projecting into said large aperture of said stripper plate to a depth less than a top surface of said stripper plate and said rotary hole cutter includes a pair of pressure rollers mounted on a rotatable and reciprocal vertical shaft above said web of material, said pressure rollers mounted to reciprocate into said large aperture of said pusher plate and to contact said web of material.

6. The invention in accordance with claim 5 wherein said pusher plate, when moved downwardly toward said stripper plate will contact said web of plastic material and urge said plastic material into contact with said rubber ring of said stripper plate and further urge said web of plastic material into contact with said cutting knife by urging said stripper plate top surface below a cutting edge of said cutting knife.

* * * * *